US006290112B1

(12) United States Patent
Iver

(10) Patent No.: US 6,290,112 B1
(45) Date of Patent: Sep. 18, 2001

(54) BELT MOUNTED KEY HOLDER

(76) Inventor: Morton Iver, 1502 N. Federal Hwy. #5, Lake Worth, FL (US) 33460

( * ) Notice: Subject to any disclaimer, the term of this patent is extended or adjusted under 35 U.S.C. 154(b) by 0 days.

(21) Appl. No.: 09/587,606

(22) Filed: Jun. 5, 2000

Related U.S. Application Data

(60) Provisional application No. 60/152,967, filed on Sep. 9, 1999.

(51) Int. Cl.[7] ..... A45F 5/00

(52) U.S. Cl. ..... 224/271; 224/197; 224/667; 224/671; 224/674; 224/269; 24/3.6; 24/3.12

(58) Field of Search ..... 224/191, 197, 224/667, 671, 672, 674, 271, 272, 269; 24/3.1, 3.6, 3.11, 3.12

(56) References Cited

U.S. PATENT DOCUMENTS

| | | | | |
|---|---|---|---|---|
| 1,797,098 | * | 3/1931 | Minehart . | |
| 2,465,328 | * | 3/1949 | Modrey | 24/3.6 X |
| 2,743,894 | * | 5/1956 | Ostnas . | |
| 2,986,786 | * | 6/1961 | Hill | 24/3.6 |
| 3,929,266 | * | 12/1975 | Kim . | |
| 3,970,227 | * | 7/1976 | Hardy | 24/3.6 X |
| 4,113,156 | | 9/1978 | Brito . | |
| 4,150,464 | | 4/1979 | Tracy . | |
| 4,166,557 | | 9/1979 | Conley . | |
| 4,171,555 | | 10/1979 | Bakker . | |
| 4,226,105 | * | 10/1980 | Wehrman . | |
| 4,877,167 | * | 10/1989 | McNemar | 224/269 |
| 5,123,580 | | 6/1992 | Lee . | |
| 5,363,680 | * | 11/1994 | Wu | 24/3.6 X |
| 5,446,947 | | 9/1995 | Lee . | |
| 5,622,296 | * | 4/1997 | Pirhonen et al. | 224/197 |
| 5,778,495 | * | 7/1998 | Paugh | 224/271 X |
| 5,865,357 | * | 2/1999 | Goodwin | 224/667 X |
| 6,161,266 | * | 12/2000 | Anscher | 24/3.6 X |
| 6,176,403 | * | 1/2001 | Svare et al. | 224/271 X |

* cited by examiner

*Primary Examiner*—Gregory M. Vidovich
(74) *Attorney, Agent, or Firm*—Alvin S. Blum

(57) ABSTRACT

A holder for keys on rings has a belt retaining flattened loop through which a belt passes. The flattened loop has a front face formed by a short top leg and a longer bottom leg that is bent inwardly to resiliently engage the front surface of the belt to prevent the device from inadvertently sliding off the belt. The lower leg forms a bight that holds a clasp member of a clasp and receptacle combination well known in the art of molded plastic strap buckles on luggage. The receptacle member that releasably locks onto the clasp member is constructed to hold one or more rings of keys. The receptacle member with its keys can be released and reattached to the belt with one hand. The belt retaining portion may be removed from or attached to the belt without unbuckling the belt.

8 Claims, 1 Drawing Sheet

BELT MOUNTED KEY HOLDER

This application is based upon provisional patent application serial number 60/152,967 filed Sep. 9, 1999, incorporated herein by reference.

BACKGROUND OF THE INVENTION

This invention relates to belt mounted accessories, and more particularly to a device that mounts on a belt to hold keys such that the keys may be readily detached for use, and then reattached, while the device itself may be removed from the belt and reattached without unbuckling the belt even though the device will not fall off the belt when unbuckled.

DESCRIPTION OF THE PRIOR ART

Lee, in U.S. Pat. Nos. 5,123,580 and 5,446,947 reviews the prior art and teaches the advantages of a key holder that may be removably attached to a belt without unbuckling the belt. His devices do not permit ready removal of the keys for use and reattachment. Tracy in U.S. Pat. No. 4,150,464 and Bakker in U.S. Pat. No. 4,171,555 teach buckles that are favorite devices for luggage straps and the like because they permit easy attachment and detachment with one hand. They are inexpensive to manufacture and durable.

SUMMARY OF THE INVENTION

It is accordingly an object of the invention to provide a key holder that may be easily attached and reattached to a belt without unbuckling the belt. It is another object of the invention to provide a portion of the device that holds keys and that may be readily detached from the belt attached portion for use of the keys and that may then be readily reattached, all with one hand. It is yet another object that the device of the invention be manufactured inexpensively from molded plastic. The device of the invention employs a connector similar to the buckles taught by Tracy and Bakker, with a female portion holding one or more rings readily detached with one hand from a male portion that is attached to the belt by a flattened loop. The loop is open at both ends to pass a belt therethrough. The loop has one broad uninterrupted first side. An opposed broad second side is made up of a short upper leg and a longer lower leg. The lower leg is bent inward toward the first side. It is resilient, so that it elastically engages the outward face of the belt. This prevents the loop from inadvertently sliding off the belt when the belt is unbuckled. The gap between upper and lower legs enables the user to mount or remove the device from a belt without unbuckling the belt.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 2:
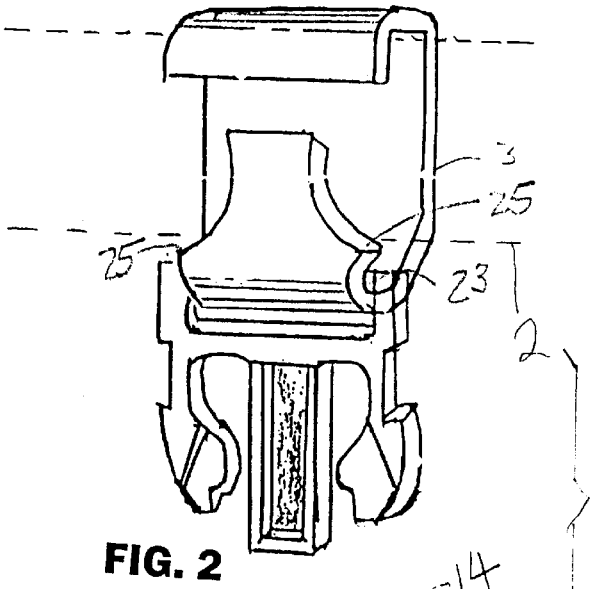
FIG. 2 is a perspective view of the assembled device with the lower portion detached for use of the key.
Figure 3:
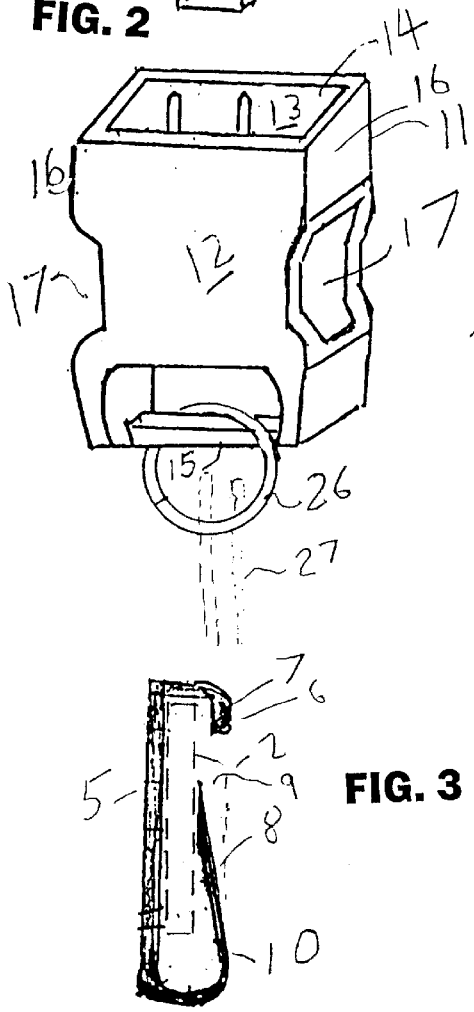
FIG. 3 is a side view of the belt fastener portion of the device.
Figure 1:
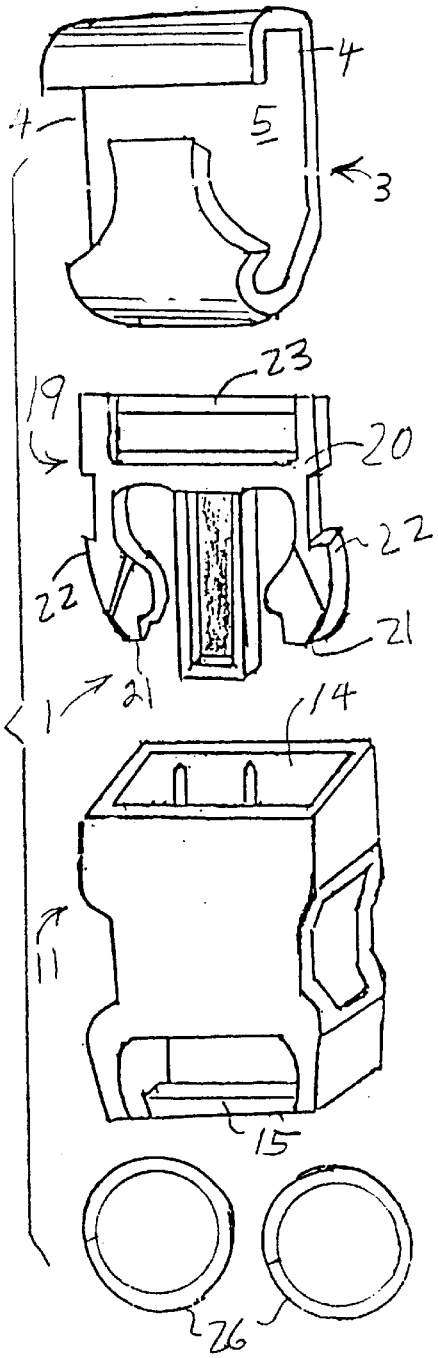
FIG. 1 is an exploded perspective view of the device of the invention.

Referring now to the drawings, a key holder 1 of the invention includes a belt fastening portion 3 having a generally flattened loop configuration with two open ends 4 for passage of a belt 2 (shown in phantom) therethrough. The belt fastening portion 3 has a broad uninterrupted first side 5, an interrupted broad second side 6 made up of a short upper leg 7, and a longer lower leg 8 that is bent inwardly an amount 9 so as to form a bight 10. The leg 8 is resilient so as to engage the front surface of belt 2 with spring bias to prevent the holder from inadvertently sliding off the belt when the belt is unbuckled.

A clasp member 19 includes a base member 20, and a pair of resilient arms 21 extending outwardly from body member 19 to terminate in locking tabs 22. Extending opposite the arms from base member 19 is bar member 23. Bar member 23 fits into bight 10 of belt fastener portion 3, where its ability to rotate within the bight is limited by outward flare 25 on leg 8. This limitation of rotation facilitates attaching and removal of the receptacle member 11 and its associated keys with one hand. The belt fastening portion 3 may be mounted on, and removed from, many belts without unbuckling the belt by passage through the gap between upper leg 7 and lower leg 8.

Receptacle member 11 includes a generally flat tubular body having relatively wider front wall 12 and back wall 13 and relatively narrower side walls 16, an opening 14 at one end for receiving therein the resilient arms 21 of clasp member 19. Locking slots 17 in side walls 16 positioned a predetermined distance from opening 14 lockingly receive the locking tabs 22 when the clasp is pushed into the opening 14. The clasp member is held securely in place until the locking tabs are deliberately squeezed together and the receptacle member pulled free in a manner well known to users of this type of connector. A key ring retaining member 15 affixed to the end of receptacle opposite the open end is constructed for retaining one or more rings that hold keys 27 (shown in phantom), such as the split rings 26 shown. The key holder 1 may further be provided with indicia on at least one of the lower leg 8 of the belt fastening portion 3 or the relatively wider front wall 12 and back wall 13 of the receptacle member 11.

The above disclosed invention has a number of particular features which should preferably be employed in combination, although each is useful separately without departure from the scope of the invention. While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A key holder adapted to be mounted on a belt, the holder comprising:

a) a belt fastener portion having a flattened loop configuration with two open ends adapted for passing the belt therethrough, one uninterrupted broad first side, and an opposed broad second side made up of a short upper leg and a longer lower leg, with a gap between the two legs, and the lower leg bent inward toward the first side and being sufficiently resilient such that the lower leg is adapted to resiliently engage a broad face of the belt to prevent the holder from inadvertently slipping off the belt when the belt is unbuckled, the lower leg forming a bight at the lower end of the loop;

b) a receptacle member including a generally flat tubular body having relatively wider front and back walls and relatively narrower side walls, an opening at a first end of said body for receiving a clasp member, and locking slot means including a pair of through slots formed in opposing facing relation in said side walls and spaced apart from said opening in said one end a predetermined distance, and a key ring retaining member affixed to a second end of said body;

c) a clasp member including a base member and a pair of resilient arms extending outwardly from opposite ends of said base member, each of said resilient arms including locking tab means for releasably engaging said locking slot means of said receptacle member; and d) a bar member extending parallel to said base member and having ends attached to said base member away from resilient arms, said bar member constructed for being held within said bight of said belt fastener portion.

2. The key holder according to claim 1, in which said lower leg of said belt portion includes an outwardly flared portion to limit upward rotation of said clasp member.

3. The key holder according to claim 2, in which at least one of said lower leg of said belt portion, or said relatively wider front and back walls of said receptacle member are provided with indicia.

4. The key holder according to claim 1, in which at least one of said lower leg of said belt portion, or said relatively wider front and back walls of said receptacle member are provided with indicia.

5. The key holder according to claim 4 formed from molded plastic.

6. The key holder according to claim 3 formed from molded plastic.

7. The key holder according to claim 2 formed from molded plastic.

8. The key holder according to claim 1 formed from molded plastic.

* * * * *